US010227947B2

(12) United States Patent
Koyama et al.

(10) Patent No.: US 10,227,947 B2
(45) Date of Patent: Mar. 12, 2019

(54) CYLINDER HEAD FOR VEHICLE ENGINE

(71) Applicants: MITSUBISHI JIDOSHA KOGYO KABUSHIKI KAISHA, Tokyo (JP); MITSUBISHI JIDOSHA ENGINEERING KABUSHIKI KAISHA, Okazaki-shi, Aichi (JP)

(72) Inventors: Kazuaki Koyama, Tokyo (JP); Yuya Okamoto, Tokyo (JP); Akira Yoshihara, Tokyo (JP); Norio Takayasu, Okazaki (JP); Genki Takahashi, Okazaki (JP)

(73) Assignees: Mitsubishi Jidosha Kogyo Kabushiki Kaisha, Tokyo (JP); Mitsubishi Jidosha Engineering Kabushiki Kaisha, Okazaki-shi, Aichi (JP)

( * ) Notice: Subject to any disclaimer, the term of this patent is extended or adjusted under 35 U.S.C. 154(b) by 4 days.

(21) Appl. No.: 15/464,967

(22) Filed: Mar. 21, 2017

(65) Prior Publication Data

US 2017/0298861 A1 Oct. 19, 2017

(30) Foreign Application Priority Data

Apr. 14, 2016 (JP) ..... 2016-080990

(51) Int. Cl.

| | |
|---|---|
| ***F01N 13/10*** | (2010.01) |
| ***F02F 1/36*** | (2006.01) |
| ***F02F 1/24*** | (2006.01) |
| ***F02F 1/40*** | (2006.01) |
| ***F01P 3/02*** | (2006.01) |
| ***F01P 11/04*** | (2006.01) |
| ***F02F 1/42*** | (2006.01) |

(52) U.S. Cl.
CPC *F02F 1/36* (2013.01); *F01P 3/02* (2013.01); *F01P 11/04* (2013.01); *F02F 1/243* (2013.01); *F02F 1/40* (2013.01); *F02F 1/42* (2013.01); *F01P 2003/024* (2013.01)

(58) Field of Classification Search
CPC .. F01P 3/02; F01P 2003/027; F01P 2003/021; F01P 3/14; F02F 1/40; F02F 1/14; F02F 1/10; F02F 1/36; F02F 2001/104; F02F 1/166
USPC ..... 123/41.01, 41.72, 41.74, 41.82 R
See application file for complete search history.

(56) References Cited

U.S. PATENT DOCUMENTS 4,993,227 A * 2/1991 Nagura ..... F02B 37/02 123/41.82 R
7,784,442 B2 8/2010 Lester et al.
(Continued)

FOREIGN PATENT DOCUMENTS

AT 414022 B * 8/2006 ..... F02F 1/36
DE 102014201338 A1 7/2014
(Continued)

*Primary Examiner* — Marguerite McMahon
*Assistant Examiner* — Tea Holbrook
(74) *Attorney, Agent, or Firm* — Birch, Stewart, Kolasch & Birch, LLP

(57) ABSTRACT

A cylinder head containing an exhaust system manifold for an engine includes screw holes formed through a fastening face of the cylinder head and an exhaust pipe, and outlet cooling channels that are provided adjacent to an outlet of a confluence of the manifold, and are disposed between the screw holes and the outlet. Coolant flows through the outlet cooling channels.

5 Claims, 5 Drawing Sheets

(56) References Cited

U.S. PATENT DOCUMENTS 8,146,543 B2 4/2012 Kuhlbach et al.
8,146,544 B2 4/2012 Lopez-Crevillen et al.
8,671,904 B2 3/2014 D' Anna et al.
8,714,128 B2 5/2014 Galeazzi et al.
8,857,385 B2 10/2014 Beyer et al.
8,904,773 B2 12/2014 Maruyama et al.
8,960,137 B2 2/2015 Brewer et al.
2008/0308050 A1 12/2008 Kuhlbach et al.
2009/0000578 A1* 1/2009 Reustle ..... B22D 15/02 123/41.82 R
2009/0126659 A1* 5/2009 Lester ..... F01N 3/046 123/41.72
2010/0089343 A1* 4/2010 Hamada ..... F01P 3/02 123/41.74
2010/0224144 A1 9/2010 Lopez-Crevillen et al.
2011/0226197 A1 9/2011 Maruyama et al.
2011/0277723 A1* 11/2011 Galeazzi ..... F02F 1/243 123/193.5
2011/0315129 A1* 12/2011 Kojima ..... F02F 1/243 123/568.12
2012/0012073 A1* 1/2012 Brewer ..... F01N 13/105 123/41.74
2012/0090566 A1* 4/2012 Knollmayr ..... F02F 1/40 123/41.82 R
2012/0227686 A1 9/2012 D' Anna et al.
2012/0227687 A1 9/2012 Galeazzi et al.
2012/0312257 A1 12/2012 Beyer et al.
2013/0055971 A1 3/2013 Brewer et al.
2013/0340692 A1* 12/2013 Slike ..... F01N 13/105 123/41.31
2015/0292389 A1* 10/2015 Clark ..... F01P 3/02 123/193.5
2015/0369167 A1* 12/2015 Beyer ..... F02F 1/16 123/41.74
2016/0061149 A1* 3/2016 Moran ..... F02F 1/243 123/568.13
2016/0186641 A1* 6/2016 Ogino ..... F01P 3/02 123/41.74
2017/0175669 A1* 6/2017 Kawakami ..... F02F 1/243
2017/0254298 A1* 9/2017 Beyer ..... F02M 26/30

FOREIGN PATENT DOCUMENTS

EP 2497931 A1 9/2012
EP 2500558 A1 9/2012
JP 2008-309158 A 12/2008
JP 2009-257157 A 11/2009
JP 2011-94523 A 5/2011

* cited by examiner

CYLINDER HEAD FOR VEHICLE ENGINE

CROSS-REFERENCE TO THE RELATED APPLICATION

This application incorporates by references the subject matter of Application No. 2016-080990 filed in Japan on Apr. 14, 2016 on which a priority claim is based under 35 U.S.C. § 119(a).

FIELD

The present invention relates to a cylinder head containing an exhaust system manifold for an engine.

BACKGROUND

A cylinder head integrally formed with an exhaust system manifold has been conventionally developed, wherein multiple exhaust ports connected to combustion chambers of an engine merge inside the cylinder head. Such a cylinder head is advantageous in that a shorter distance between an exhaust purification catalyst provided in the exhaust system and the engine improves the performance of the exhaust purification, and that a shorter exhaust system per se reduces the pressure loss of the exhaust and enhances the size reduction of the engine. Such a cylinder head, on the other hand, has a disadvantage in that the temperature may be increased due to exhaust heat, as compared to a cylinder head provided separately with a manifold. To address this issue, techniques have been proposed to improve the cooling performance by permitting engine cooling water (coolant) to flow around an exhaust port and in the vicinity of an outlet of a manifold (refer to Japanese Laid-open Patent Publication No. 2008-309158).

In the meantime, the temperature tends to rise at an outlet of a manifold contained in a cylinder head particularly because exhausts from exhaust ports tend to converge in the vicinity of the outlet of the manifold. Because downstream side exhaust pipes are fastened and secured to outlets of a manifold, there is a need for a structure that can efficiently cool the vicinity of the outlet, for the purpose of suppressing a reduction in the clamping force of fastening members, thereby maintaining a stable clamping force.

SUMMARY

Technical Problems

The present disclosure is conceived of in view of the issues set forth above, and an object thereof is to provide a cylinder head for an engine that can suppress a reduction in the clamping force of fastening members, thereby maintaining a stable clamping force. Any other advantages and effects that can be achieved by configurations described in a mode for embodying the invention described later, and that cannot be obtained by conventional techniques, are also other objects of the present disclosure.

Solution To Problems

A cylinder head discloses herein is a cylinder head including a manifold provided inside the cylinder for an exhaust system of an engine; screw holes formed through a fastening face of the cylinder head and an exhaust pipe; and outlet cooling channels that are provided adjacent to an outlet of a confluence of the manifold, and are disposed between the screw holes and the outlet, such that coolant flows through the outlet cooling channels.

BRIEF DESCRIPTION OF DRAWINGS

The nature of this invention, as well as other objects and advantages thereof, will be explained in the following with reference to the accompanying drawings, in which like reference characters designate the same or similar parts throughout the figures and wherein.

DESCRIPTION OF EMBODIMENTS

A cylinder head for an engine as an embodiment will be described with reference to the drawings. Embodiments that will be described below are merely exemplary, and it is not intended to exclude modifications and applications of techniques that are not discussed explicitly in the following embodiments. The configurations of the present embodiment maybe practiced in a wide variety of modifications without departing from the spirit thereof. In addition, the configurations may be selected where necessary, or may be combined in any combinations.

(1. Overview of Configuration)

Figure 1:
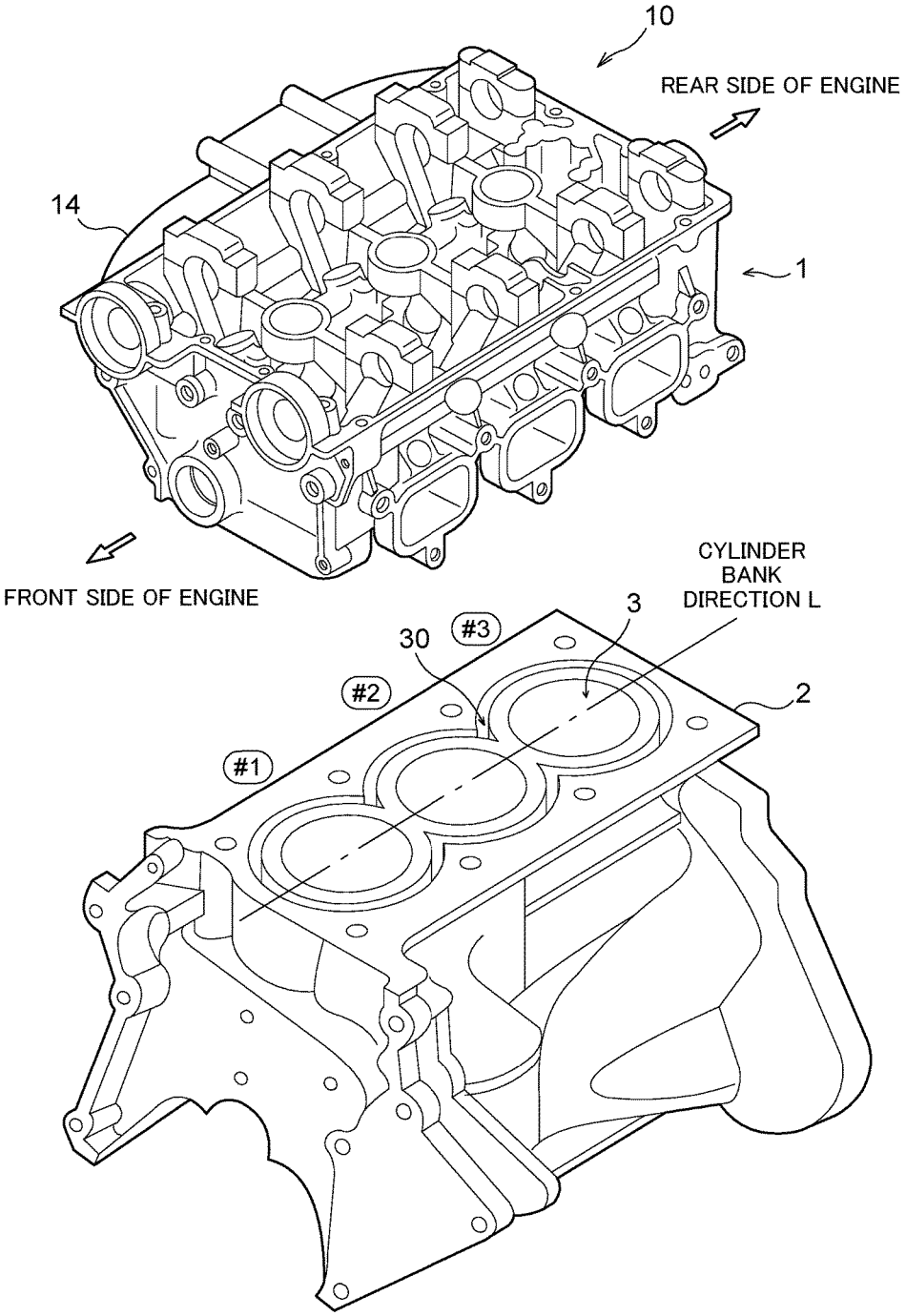
FIG. 1 is a perspective diagram exemplifying a cylinder head and a cylinder block for an engine according to an embodiment.

A cylinder head 1 of the present embodiment is an exhaust-manifold integrated-type cylinder head having an exhaust system manifold integrated in the cylinder head 1, and is to be attached to a cylinder block 2 of a water-cooled multi-cylinder engine 10. In the following descriptions, the "lower" defined as the side on which the cylinder block 2 is secured to the cylinder head 1, and the opposite side is defined as the "upper". Multiple cylinders 3 are disposed in a bank in the engine 10. The example shown in FIG. 1 is a three-cylinder engine 10, wherein three cylinders 3 are arranged in series, and the cylinder 3 at one (front) of ends of the long side direction of the engine 10 is denoted by #1, followed by #2 and #3 toward the other end (rear). The direction along which the cylinders 3 are arranged in a bank (long side direction) is denoted by the reference symbol L.

Figure 2:
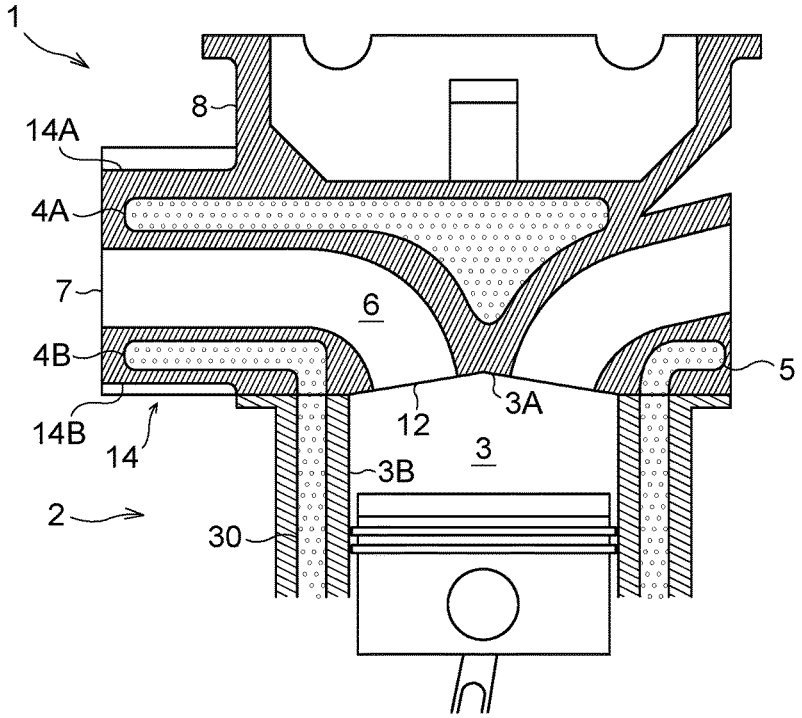
FIG. 2 is a vertical cross-sectional schematic diagram of the engine.

As shown in FIGS. 1 and 2, a cooling channel 30 (water jacket) is grooved in curved configuration along the cylinder surface 3B of each cylinder 3. The top of the cooling channel 30 opens at the top face of the cylinder block 2, for permitting communications between an exhaust side cooling channel 4 (4B) and an intake side cooling channel 5 formed inside the cylinder head 1. As a result, the outer periphery of an exhaust port 6 is cooled by engine cooling water (hereinafter referred to as "coolant"). While the cooling channels 4 and 5 on the side of the cylinder head 1 on the exhaust side and on the intake side are denoted by different reference symbols in this example for the sake of convenience, the cooling channels 4 and 5 are provided integrally inside the cylinder head 1.

Figure 3:
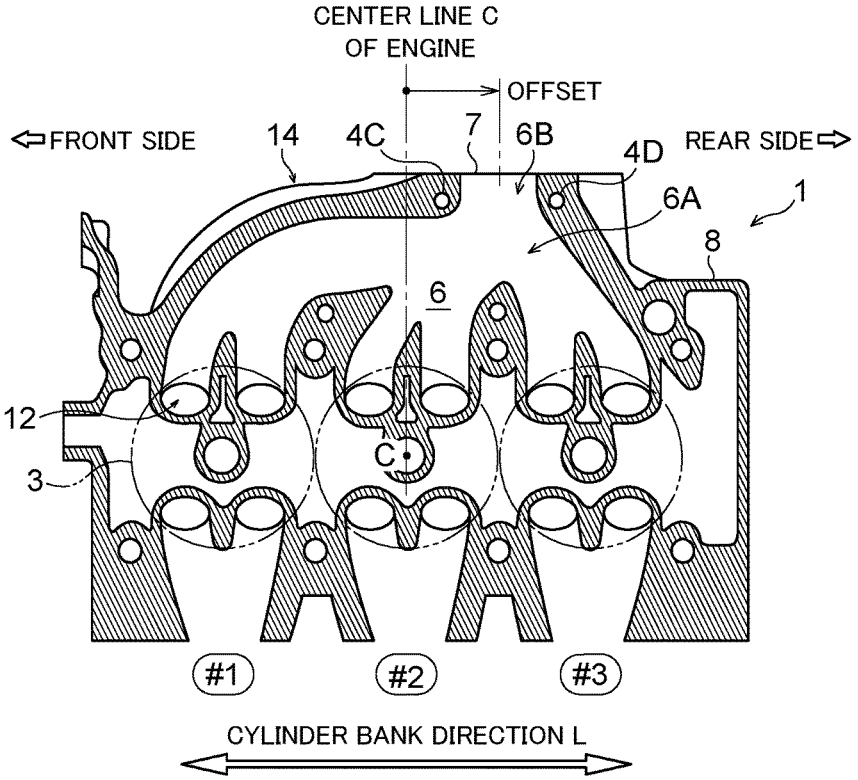
FIG. 3 is a horizontal cross-sectional diagram showing the configuration of an exhaust port inside the cylinder head.

As shown in FIG. 2, a depression defining a ceiling face 3A of a combustion chamber is formed in the bottom face of the cylinder head 1. The exhaust ports 6 are branched exhaust flow channels, and are connected to respective combustion chambers. The exhaust ports 6 merge together and the number of branches reduces as the exhaust ports 6 extend farther from the combustion chambers, and form the manifold inside the cylinder head 1. As shown in FIG. 3, the upstream end of the exhaust ports 6 has six branches, which are connected to corresponding exhaust valve holes 12. In the downstream to the exhaust ports 6, the channels are merged into a single channel inside the cylinder head 1. Hereinafter, the merged part of the exhaust ports 6 is referred to as an exhaust confluence 6A.

Considering a line vertical to the cylinder bank direction L of imaginary lines extending horizontally through the center of the cylinder #2 as the center line C of the engine 10, the exhaust confluence 6A is displaced to the rear side of the engine 10 relative to the center line C. Similarly, a single opening at the downstream end of the exhaust confluence 6A (hereinafter referred to as the "exhaust port 7") is also displaced to the rear side relative to the center line C. As shown in FIGS. 1-3, a protruding section 14 surrounding the entire exhaust port 6 is provided on a side wall 8 on the exhaust side so as to protrude outwardly from the cylinder head 1 in a semicircular shape.

Figure 6A:
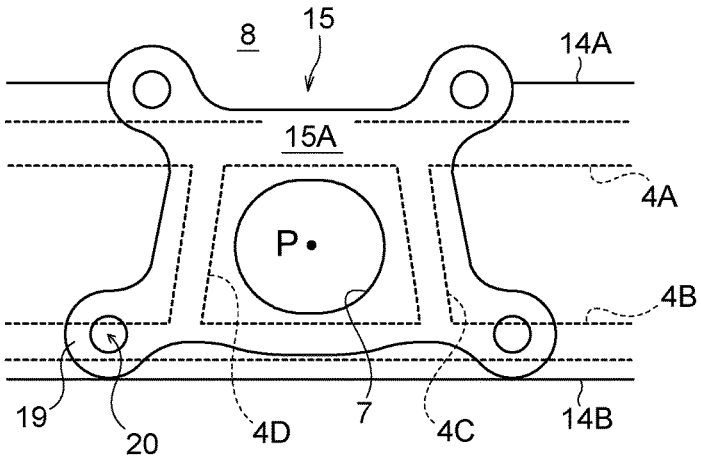
FIG. 6A is a diagram of a fastening face of the cylinder head in the frontal view.

As shown in FIG. 6A, a flange section 15 is provided which has a planer fastening face 15A that is vertical to the flow direction of the exhaust gas surrounding the exhaust port 7. On the flange section 15, an unillustrated downstream side exhaust pipe (including pipe members for connecting to a catalyst device, a turbo charger and other devices) is to be fastened and secured to. The fastening face 15A of the flange section 15 is provided so as to surround the exhaust port 7 annularly on the left, right, top and bottom.

The flange section 15 has multiple boss sections 19 for attaching fastening members (e.g., bolts or screws). Each boss section 19 has a screw hole 20 having a thread groove formed on its inner surface, such that the thread groove is to be threaded with a fasting member. The screw hole 20 is formed in the direction vertical to the fastening face 15A. The boss sections 19 are positioned surrounding the periphery of the exhaust port 7 and spaced apart from each other at a certain distance. In the example shown in FIG. 6A, the boss sections 19 are formed at the four corners of the fastening face 15A that has an annular shape.

Two boss sections 19 (the screw holes 20) above the exhaust port 7 are positioned on the left and the right of the exhaust port 7 (on the left and the right at substantially equal distances from the center point P of the exhaust port 7 in the frontal view of the fastening face 15A). Similarly, two boss sections 19 (the screw holes 20) below the exhaust port 7 are positioned on the left and the right of the exhaust port 7 (on the left and the right at substantially equal distances from the center point P of the exhaust port 7). Among the four boss sections 19, the boss sections 19 located above are formed such that the upper ends of those two boss sections 19 protrude slightly upwardly relative to the top face 14A of the protruding section 14. On the other hand, the boss sections 19 located below are formed such that the lower ends of those two boss sections 19 are aligned with the bottom face 14B of the protruding section 14 (such that they do not protrude downwardly relative to the bottom face 14B of the protruding section 14).

(2. Cooling Channels)

Figure 4:
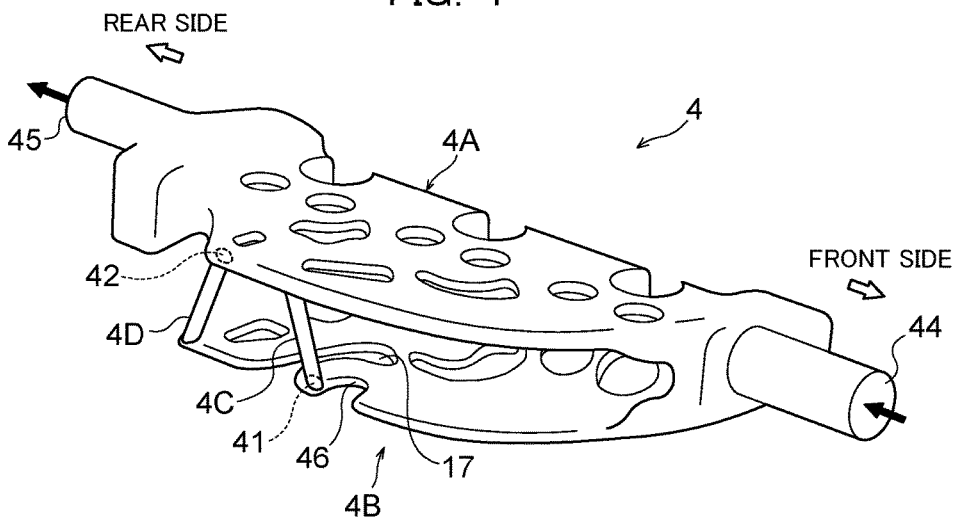
FIG. 4 is a perspective diagram showing an exhaust side cooling channel in the cylinder head.

An example of the exhaust side cooling channel 4 (water jacket) inside the cylinder head 1 is shown in FIG. 4. The coolant is to flow through the cooling channels 4 in order to cool the outer periphery of the above-described exhaust port 6 (the exhaust system manifold provided in the cylinder head 1). The cylinder head 1 is provided with two cooling channels 4A and 4B that are disposed to sandwich the exhaust port 6 from the top and the bottom, as a part of the cooling channels 4. The cylinder head 1 is also provided with outlet cooling channels 4C and 4D for cooling the outlet 6B of the exhaust port 6.

The cylinder head 1 of the present embodiment is provided with a coolant inlet 44 to which coolant is fed from the water pump side, on the front side of the engine 10 (one end of the long side direction), and a coolant outlet 45 on the rear side (the other end of the long side direction). Therefore, the coolant flows in each of the cooling channels 4A and 4B from the front side to the rear side. The cooling channel 4A and the cooling channel 4B above and below the exhaust port 6 are disposed along the top and bottom faces of the exhaust port 6, respectively. The cooling channels 4A and 4B communicate to each other in the vicinity of the ceiling face 3A of the cylinder 3, and are separated from each other in the protruding section 14. The cooling channels 4A and 4B are provided in planer configurations that are substantially parallel to the top face 14A and the bottom face 14B of the protruding section 14, respectively.

Figure 5A:
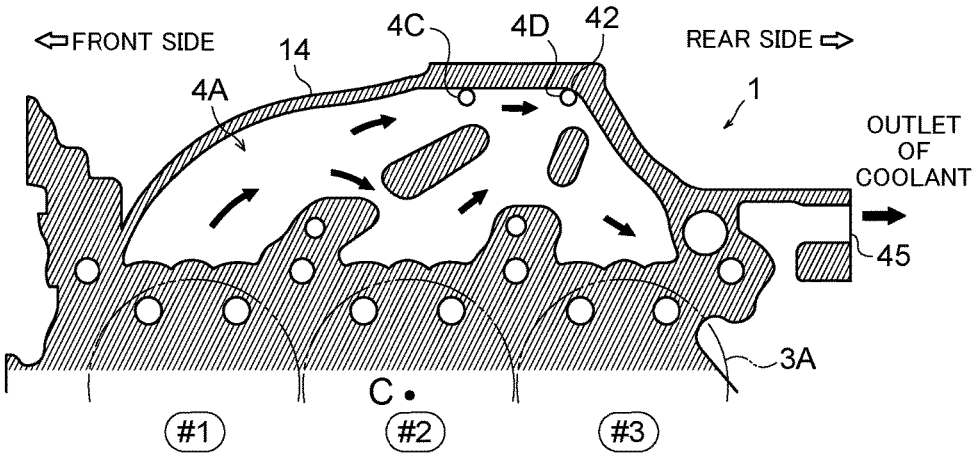
FIG. 5A is a horizontal cross-sectional diagram showing a top of the cooling channel (upper cooling channel) in FIG. 4.
Figure 5B:
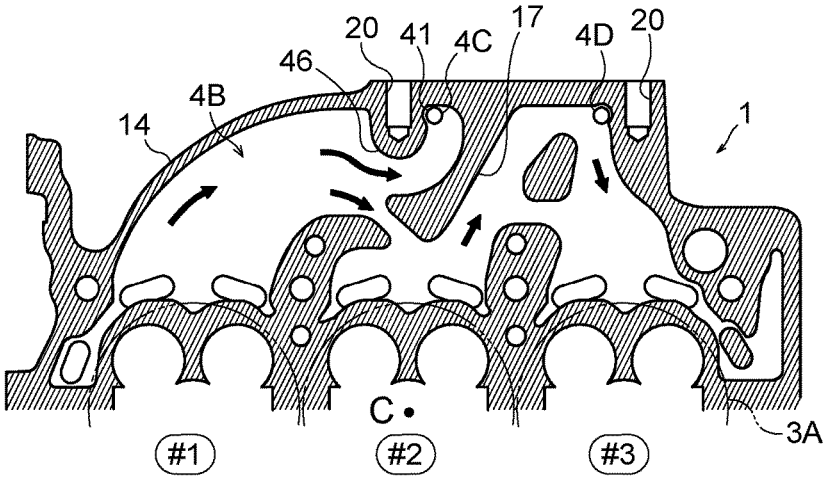
FIG. 5B is a horizontal cross-sectional diagram showing a bottom of the cooling channel (lower cooling channel) in FIG. 4.

FIGS. 5A and 5B are cross-sectional diagrams showing cross sections of the upper and lower cooling channels 4A and 4B on the planes substantially parallel to the top face 14A and the bottom face 14B of the protruding section 14, respectively. Note that the alternate long and two short dashed lines in FIGS. 5A and 5B represent the contours of the ceiling faces 3A of the cylinders 3. Each of the cooling channels 4A and 4B in the protruding section 14 is shaped such that the coolant meanders through the cooling channel 4A, 4B toward the rear side, while the coolant is branched and merged. Further, as shown in FIG. 6A, the upper cooling channel 4A of the present embodiment is located downward relative to the upper screw holes 20 not to interfere with these screw holes 20 provided in the fastening face 15A. On the other hand, the lower cooling channel 4B is provided at the position to interfere with the lower screw holes 20 in the frontal view of the fastening face 15A.

The outlet cooling channels 4C and 4D are provided adjacent to the outlet 6B of the exhaust port 6, and are parts of flow channels disposed between the screw holes 20 and the outlet 6B, such that the outlet 6B of the exhaust port 6 is cooled when the coolant passes inside the outlet cooling channels 4C and 4D. As used therein the "outlet 6B" refers to a downstream part of the exhaust confluence 6A, and the immediate upstream part of the exhaust port 7, as shown in FIG. 3. The outlet cooling channels 4C and 4D of the present embodiment are disposed between the screw holes 20 provided in the lateral side of the outlet 6B and the outlet 6B, and extend in the vertical direction.

Figure 6B:
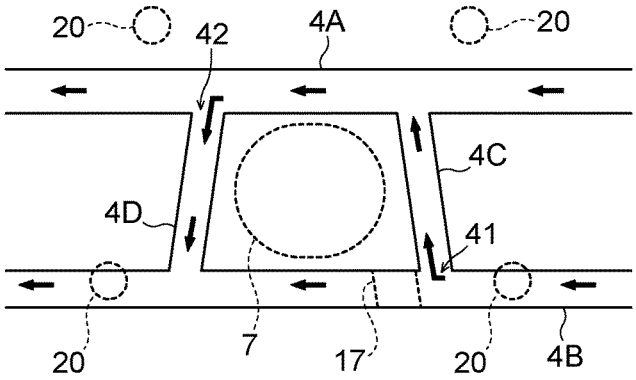
FIG. 6B is a schematic diagram for illustrating the configuration of cooling channels in FIG. 6A.

As shown in FIGS. 6A and 6B, in the cylinder head 1 of the present embodiment, the two outlet cooling channels 4C and 4D are disposed so as to sandwich the outlet 6B of the exhaust port 6 from the front and the rear. The outlet cooling channels 4C and 4D permit communications between the upper and lower cooling channels 4A and 4B on the side of the exhaust port 7 relative to the screw holes 20 (i.e., between the screw holes 20 and the outlet 6B), in the frontal view of the fastening face 15A. The outlet cooling channels 4C and 4D of the present embodiment are provided obliquely relative to the upper and lower cooling channels 4A and 4B (in a truncated chevron arrangement), such that the horizontal distance between the outlet cooling channels 4C and 4D is reduced as they are located closer to the top. In this manner, the outlet cooling channels 4C and 4D form flow channels in the isosceles trapezoid shape, in which the upper bottom is shorter than the lower bottom, around the outlet 6B of the exhaust port 6, in the frontal view of the fastening face 15A.

The coolant flows from the inlet 41 provided in the lower cooling channel 4B, into the outlet cooling channel 4C located on the side of the coolant inlet 44 relative to the exhaust port 7 (front side). The coolant that has passed through the outlet cooling channel 4C merges with the flow of the coolant through the upper cooling channel 4A. On the other hand, the coolant flows from the inlet 42 provided in the upper cooling channel 4A, into the outlet cooling channel 4D located on the side of the coolant outlet 45 relative to the exhaust port 7 (rear side). The coolant that has passed through the outlet cooling channel 4D merges with the flow of the coolant through the lower cooling channel 4B. The outlet cooling channels 4C and 4D of the present embodiment are formed to have the substantially same cross-sectional areas of the flow channels.

As shown in FIG. 5B, a part of the flow (hereinafter referred to as "branched flow") branched out from the coolant flowing through the lower cooling channel 4B (hereinafter referred to as "the main stream") flows into the inlet 41 of the outlet cooling channel 4C. The inlet 41 is disposed on the rear side relative to the front side screw holes 20 and outside the cylinder head 1 relative to the ends of the screw holes 20. The lower cooling channel 4B is shaped to circumvent the front side screw holes 20, and the inlet 41 is positioned at the end of the circumventing section (hereinafter referred to as "the circumvention section 46").

The lower cooling channel 4B of the present embodiment is provided with a guide section 17 for guiding the coolant to the outlet cooling channel 4C. The guide section 17 is disposed on the side of the coolant outlet 45 relative to the inlet 41 (downstream to the flow direction of the coolant), as a protrusion protruding inwardly from the outer wall of the cylinder head 1 defining the lower cooling channel 4B (i.e., the side wall section of the protruding section 14). As shown in FIG. 4, since no coolant flows at the position where the guide section 17 is provided, a flow channel toward the inlet 41 is formed by the guide section 17.

As shown in FIG. 5B, the guide section 17 of the present embodiment protrudes obliquely from the outer wall of the cylinder head 1 toward the front side. The surface of the guide section 17 on the side of the inlet 41 is curved such that the guide section 17 and the circumvention section 46 together form a flow channel having a constant cross-sectional area of the flow channel. As a result, a flow of coolant from the front side is smoothly guided to the inlet 41. Further, the guide section 17 is formed to protrude for reducing the cross-sectional area of the flow channel of the main stream through the lower cooling channel 4B. In this manner, the guide section 17 of the present embodiment is configured to separate the flow of the coolant flowing through the lower cooling channel 4B into the main stream and the branched flow and to increase the flow speed of the main stream, as well as enhancing the flow volume of the branched flow.

As shown in FIG. 5A, the inlet 42 of the outlet cooling channel 4D on the rear side is disposed outside the upper cooling channel 4A and at the rear side corner. As a result, the outer wall of the cylinder head 1 (the side wall section of the protruding section 14) per se function as a guide section, such that a part of the coolant flowing through the upper cooling channel 4A is guided to the outlet cooling channel 4D. Note that the outlet cooling channels 4C and 4D of the present embodiment are formed by perforating the top face or the bottom face of the protruding section 14, and sealing a resultant opening in the top face or the bottom face with a plug, for example.

(3. Advantages and Effects)

(1) In accordance with the cylinder head 1 described above, because it is possible to cool the outlet 6B of the exhaust port 6 (manifold) by the outlet cooling channels 4C and 4D, an exhaust gas ejected from the exhaust port 6 is cooled efficiently. Further, because the outlet cooling channels 4C and 4D are disposed between the screw holes 20 and the outlet 6B of the exhaust port 6 (manifold), heat of the exhaust gas ejected from the exhaust port 7 is prevented from being conducted. This helps to suppress a reduction in the clamping force by fastening members (e.g., bolts or screws) engaged with the screw holes 20, and hence it is possible to maintain a stable clamping force.

(2) In the cylinder head 1 described above, since the coolant flows above and below the exhaust port 6 through the upper cooling channel 4A and the lower cooling channel 4B, it is possible to enhance the efficiency of the cooling around the exhaust port 6 inside the cylinder head 1. Further, because the outlet cooling channels 4C and 4D permit communications between the upper and lower cooling channels 4A and 4B, it is possible to form the outlet cooling channels 4C and 4D with simplified processing, by perforation and subsequent sealing of the resultant openings.

(3) In the cylinder head 1 described above, the lower cooling channel 4B connected to the inlet 41 of the outlet cooling channel 4C includes the guide section 17 for guiding the coolant to the outlet cooling channel 4C. Because the guide section 17 enhances influx of the coolant into the outlet cooling channel 4C, it is possible to enhance the efficiency of the cooling of the exhaust.

(4) Further, the guide section 17 is disposed downstream to the flow direction of the coolant relative to the inlet 41 of the outlet cooling channel 4C, and is provided as a protrusion protruding inwardly from the outer wall of the cylinder head 1 defining the lower cooling channel 4B. As a result, it is possible to guide the coolant efficiently to the inlet 41 of the outlet cooling channel 4C, and the efficiency of the cooling of the exhaust gas can be further improved.

(5) In the cylinder head 1 described above, because the outlet cooling channels 4C and 4D are provided extending in the vertical direction and are disposed so as to sandwich the outlet 6B of the exhaust port 6 from the front and the rear, the efficiency of the cooling of the exhaust gas can be further improved. Further, heat conduction to the screw holes 20 located at the lateral sides (left and right sides) of the exhaust port 7 can be prevented.

(6) Further, the outlet cooling channels 4C and 4D described above are provided obliquely relative to the upper and lower cooling channels 4A and 4B (in a truncated chevron arrangement), such that the horizontal distance between the outlet cooling channels 4C and 4D is reduced as they are located closer to the top. As a result, the coolant flows from the lower cooling channel 4B, into the outlet cooling channel 4C upstream to (here, on the front side of) the flow direction of the coolant. The temperature of the coolant flowing through the upper and lower cooling channels 4A and 4B is generally lower on the upstream than that on the downstream. To address this issue, it is possible to make the coolant with relatively low temperatures flow into the outlet cooling channel 4C. Further, the coolant flows from the upper cooling channel 4A, into the outlet cooling channel 4D downstream to (here, on the rear side of) the flow direction of the coolant. The temperature of the coolant flowing through the upper and lower cooling channels 4A and 4B is generally lower on the upstream than that on the downstream, and the temperature of the upper cooling channel 4A is generally lower than that of the lower cooling channel 4B. To address this issue, it is also possible to make the coolant with relatively low temperatures flow into the outlet cooling channel 4D. As a result, in the cylinder head 1 described above, the efficiency of the cooling of the exhaust gas can be further improved.

Further, because the outlet cooling channels 4C and 4D described above are arranged in a truncated chevron arrangement, it is possible to ensure that a sufficient volume of coolant flows through the outlet cooling channel 4C when the flow volume of the coolant in the lower cooling channel 4B is greater than that in the upper cooling channel 4A. In other words, when the flow volume of the coolant through the upper cooling channel 4A is different from that through the lower cooling channel 4B and the lower flow volume is greater, it is possible to make coolant in the substantially equal flow volumes flow through the two outlet cooling channels 4C and 4D by arranging the outlet cooling channels 4C and 4D in the truncated chevron arrangement, as in the cylinder head 1 of the present embodiment. This can prevent heat from conducting to the screw holes 20 located on the left and the right of the exhaust port 7.

(7) In the cylinder head 1 described above, the respective two screw holes 20 perforated in the fastening face 15A of the flange section 15 are provided both above and below an outlet 6B (an exhaust port 7), and respective fastening members are to be engaged with the screw holes 20. In the cylinder head 1 described above, because the periphery of the outlet 6B of the exhaust port 6 is cooled by coolant flowing through the outlet cooling channels 4C and 4D, the peripheries of the screw holes 20 are also cooled. Thus, it is possible to enhance the clamping force of the fastening members. Because the respective two screw holes 20 are provided both above and below the exhaust port 7 (at the four corners of the fastening face 15A) in the cylinder head 1 described above, it is possible to tighten the exhaust pipes securely.

(4. Miscellaneous)

While an embodiment of the present invention has been described, the present invention is not limited to the embodiment set forth above, and the present invention may be practiced in a wide varieties of modification without departing from the point thereof.

Figure 7A:
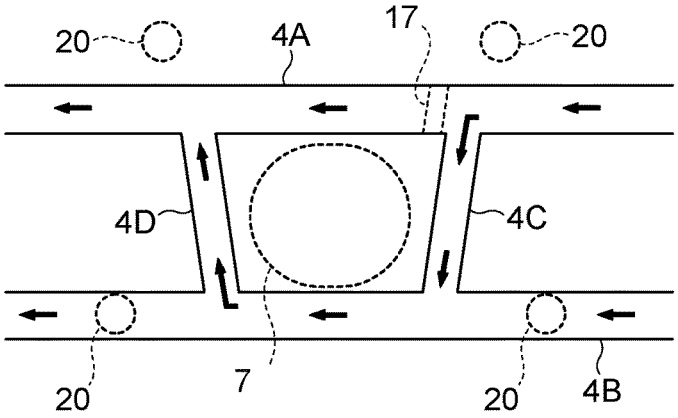
FIG. 7A and FIG. 7B are schematic diagrams for illustrating the configuration of cooling channels provided in a cylinder head in accordance with a modification.

The configurations of the outlet cooling channels 4C and 4D described above are merely exemplary and are non-limiting. For example, as shown in FIG. 7A, two outlet cooling channels 4C and 4D may be provided obliquely relative to the upper and lower cooling channels 4A and 4B (in an inversed truncated chevron arrangement), such that the horizontal distance between the outlet cooling channels 4C and 4D is increased as they are located closer to the top. In this case, the coolant will flow from the upper cooling channel 4A into the outlet cooling channel 4C upstream to the flow direction of the coolant, and the coolant will flow from the lower cooling channel 4B into the other outlet cooling channel 4D.

Even in such a configuration, the outlet 6B of the exhaust port 6 can be cooled, and the exhaust gas ejected from the exhaust port 6 can be efficiently cooled. Further, the heat of the exhaust gas ejected from the exhaust port 7 is prevented from being conducted to fastening members engaged with the screw holes 20. This prevents a reduction in the clamping force of the fastening members engaged with the screw holes 20, and it is possible to maintain a stable clamping force. Further, as shown in FIG. 7A, when the two outlet cooling channels 4C and 4D are arranged in an inversed truncated chevron arrangement, the efficiency of the cooling of the exhaust gas can be further improved because the distance between the outlet cooling channels 4C and 4D and the outlet 6B is reduced as they are located closer to the bottom.

Further, the inversed truncated chevron arrangement of two outlet cooling channels 4C and 4D ensures that a sufficient volume of coolant flows through the outlet cooling channel 4C when the flow volume of coolant through the upper cooling channel 4A is greater than that through the lower cooling channel 4B. In other words, when the flow volume of the coolant through the upper cooling channel 4A is different from that through the lower cooling channel 4B and the upper flow volume is greater, it is possible to make coolant in the substantially equal flow volumes flow through the two outlet cooling channels 4C and 4D by arranging the outlet cooling channels 4C and 4D in the inversed truncated chevron arrangement, as shown in FIG. 7A. This can prevent heat from conducting to the screw holes 20 on the left and the right of the exhaust port 7. In this manner, conduction of the exhaust heat to the screw holes 20 can be suppressed in an efficient manner by selecting either a truncated chevron or inversed truncated chevron arrangement as the arrangement of the outlet cooling channels 4C and 4D, depending on the flow volume of the coolant through the upper and lower cooling channels 4A and 4B.

In such a configuration, by providing the upper cooling channel 4A with a guide section that is similar to the above-described guide section 17, an inflow of the coolant into the outlet cooling channel 4C can be enhanced. The above-described configuration of the guide section 17 is merely exemplary, and is non-limiting. Further, another guide section for guiding coolant may also be provided to the inlet 42 of the outlet cooling channel 4D downstream to the flow direction of the coolant. Note that the guide section 17 is not an essential configuration and may be omitted. If the guide section 17 is not provided, the areas of the openings of the inlets 41 and 42 of the outlet cooling channels 4C and 4D may be increased to facilitate an inflow of the coolant, for example. Further, the outlet cooling channels 4C and 4D may not have constant cross-sectional areas of the flow channels, and the outlet cooling channels 4C and 4D may be formed such that the cross-sectional areas of the flow channels maybe gradually reduced as they are located closer to the outlets, for example. Note that the orientation of the two outlet cooling channels 4C and 4D may be perpendicular to the orientation of the upper and lower cooling channels 4A and 4B.

Figure 7B:
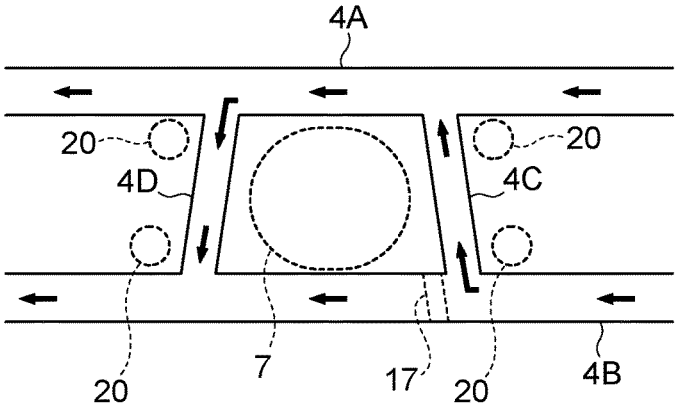

Further, the positional relationships of the upper and lower cooling channels 4A and 4B and the boss sections 19 (the screw holes 20) are not limited to the those described above. For example, as shown in FIG. 7B, the upper cooling channel 4A may be disposed above the upper screw holes 20, and the lower cooling channel 4B may be disposed in the position not to interfere with the lower screw holes 20 (below the lower screw hole 20), in the frontal view of the fastening face 15A. In such a case, it is suffice that both of the outlet cooling channels 4C and 4D are disposed on the side of the exhaust port 7 relative to the two screw holes 20 that are aligned vertically.

Even in such a configuration, because the outlet cooling channels 4C and 4D are disposed between the outlet 6B of the exhaust port 6 and the screw holes 20, heat conduction to the fastening members engaged with the screw holes 20 can be suppressed and it is possible to maintain a stable clamping force by suppressing a reduction in the clamping force. Note that the upper cooling channel 4A may be disposed at a position interfering with the upper screw holes 20. Further, the lower cooling channel 4B may be disposed above the lower screw holes 20.

The outlet cooling channels 4C and 4D may not permit communications between the upper and lower cooling channels 4A and 4B, or the outlet cooling channels 4C and 4D may be formed not to merge with one of the upper and lower cooling channels 4A and 4B.

Further, only one of the outlet cooling channels 4C and 4D may be provided, or the outlet cooling channels 4C and 4D may not extend in the vertical direction. For example, a water channel located on the side of the outlet 6B relative to the screw holes 20 may be provided as an outlet cooling channel for flowing the coolant around the outlet 6B. Alternatively, a part of the upper and lower cooling channels 4A and 4B may be configured to function as an outlet cooling channel such that the coolant flows between the screw holes 20 and the outlet 6B.

Note that the shape of the flange section 15 and the arrangements and number of the boss sections 19 (the screw holes 20) are not limited to those described above. Further, coolant in the cooling channels 4A and 4B may flow from the rear toward the front. Furthermore, the number of cylinders in the engine 10 and the position of the exhaust port 7 of the cylinder head 1 are not limited to the configurations described above.

REFERENCE SIGNS LIST

1 CYLINDER HEAD
4 EXHAUST SIDE COOLING CHANNEL
4A UPPER COOLING CHANNEL
4B LOWER COOLING CHANNEL
4C, 4D OUTLET COOLING CHANNEL
6 EXHAUST PORT (MANIFOLD)
6A EXHAUST CONFLUENCE (CONFLUENCE)
6B OUTLET
10 ENGINE
12 EXHAUST VALVE HOLE
15A FASTENING FACE
17 GUIDE SECTION
20 SCREW HOLE
41, 42 INLET

The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A cylinder head comprising:

a manifold provided inside the cylinder head for an exhaust system of an engine;

screw holes formed through a fastening face of the cylinder head and an exhaust pipe;

outlet cooling channels that are provided adjacent to an outlet of a confluence of the manifold, and are disposed between the screw holes and the outlet, such that coolant flows through the outlet cooling channels;

an upper cooling channel that permits a flow of the coolant above the manifold;

a lower cooling channel that permits a flow of the coolant below the manifold, wherein the screw holes are provided around the outlet;

at least one of the screw holes is provided on a lateral side of the outlet;

the outlet cooling channels are disposed between the screw holes provided on the lateral side and the outlet, and permit communications between the upper cooling channel and the lower cooling channel;

one of the upper cooling channel and the lower cooling channel connected to the respective inlets of the outlet cooling channels of an upstream comprises a guide section to guide the coolant to the outlet cooling channels;

the coolant in the upper coolant channel and the lower coolant channel and the lower cooling channel flows from the other of a long side direction of the engine to the other end of the long side direction of the engine; and the guide section is disposed downstream of a flowing direction of the coolant relative to the inlets of the outlet cooling channels, is configured to separate the flow of the coolant into a main stream and a branched flow, and protrudes for reducing a cross-sectional area of a flow channel of the main stream, as well as guiding the branched flow to the inlets.

2. The cylinder head according to claim 1, wherein the outlet cooling channels are provided extending in a vertical direction of the engine, and the two outlet cooling channels are disposed such that the outlet of the manifold is sandwiched from one end and the other end of the long side direction of the engine.

3. The cylinder head according to claim 2, wherein the two outlet cooling channels are disposed such that a distance between the outlet cooling channels decreases as the outlet cooling channels are located closer to the top.

4. The cylinder head according to claim 2, wherein the two outlet cooling channels are disposed such that a distance between the outlet cooling channels increases as the outlet cooling channels are located closer to the top.

5. The cylinder head according to claim 1, wherein two of the screw holes are provided above the outlet and two of the screw holes are provided below the outlet.

* * * * *